US006369801B2

(12) United States Patent
Boireau et al.

(10) Patent No.: US 6,369,801 B2
(45) **Date of Patent: *Apr. 9, 2002**

(54) CONTACT DETECTION DEVICE, APPARATUS USING SUCH A DEVICE AND RADIOTELEPHONE COMPRISING SUCH AN APPARATUS

(75) Inventors: Olivier Boireau, Le Mans; Philippe Alix, Ruaudin, both of (FR)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,045

(22) Filed: Mar. 8, 1999

(30) Foreign Application Priority Data

Mar. 13, 1998 (FR) ..... 98 03142

(51) Int. Cl.[7] ..... G09G 5/00; G09G 3/30; H01H 9/00; H01H 1/10

(52) U.S. Cl. ..... 345/169; 345/76; 200/314; 200/317; 200/513

(58) Field of Search ..... 345/36, 45, 76, 345/156, 168, 169, 170, 173, 174; 200/5 A, 314, 317, 514

(56) References Cited

U.S. PATENT DOCUMENTS

| | | | | | |
|---|---|---|---|---|---|
| 4,320,268 | A | * | 3/1982 | Brown | 200/5 A |
| 4,532,395 | A | * | 7/1985 | Zukowski | 200/314 |
| 4,882,581 | A | * | 11/1989 | Inobe et al. | 341/22 |
| 5,397,867 | A | * | 3/1995 | Demeo | 200/5 A |
| 5,414,444 | A | * | 5/1995 | Britz | 345/156 |
| 5,434,757 | A | * | 7/1995 | Kashiwagi | 200/317 |
| 5,521,345 | A | * | 5/1996 | Wulc | 200/317 |
| 5,680,160 | A | * | 10/1997 | LaPointe | 345/173 |
| 5,844,362 | A | * | 12/1998 | Tanabe et al. | 313/506 |
| 5,871,088 | A | * | 2/1999 | Tanabe | 200/514 |
| 5,901,834 | A | * | 5/1999 | Inubushi et al. | 200/314 |
| 5,950,808 | A | * | 9/1999 | Tanabe et al. | 200/314 |

FOREIGN PATENT DOCUMENTS

| | | | |
|---|---|---|---|
| EP | 0818793 A1 | 1/1998 | H01H/13/02 |
| GB | 2260025 A | 3/1993 | H01H/13/70 |

* cited by examiner

*Primary Examiner*—Bipin Shalwala
*Assistant Examiner*—Jeff Piziali
(74) *Attorney, Agent, or Firm*—Dicran Halajian

(57) ABSTRACT

A contact device includes a first insulating film having a dome and a planar surface surrounding the dome. A contact electrode is formed on an inner surface of the dome. A detection circuit is located over a second insulating film. The detection circuit detects an electric contact between the contact electrode and the detection circuit. An electroluminescent layer is formed on the planar surface, where the electroluminescent layer does not overlap over the contact electrode and is formed on the planar surface without being formed on the dome.

14 Claims, 1 Drawing Sheet

CONTACT DETECTION DEVICE, APPARATUS USING SUCH A DEVICE AND RADIOTELEPHONE COMPRISING SUCH AN APPARATUS

FIELD OF THE INVENTION

The invention relates to a contact detection device comprising:

a first insulating film constituting at least a dome having an internal surface, on which a contact electrode layer is deposited, and an external surface, and a second insulating film supporting a detection circuit for detecting an electric contact between the contact electrode layer and the detection circuit.

The invention also relates to a data communication apparatus comprising a keyboard and a detection device as mentioned above, as well as to an apparatus comprising a liquid crystal display screen.

The invention further relates to a radiotelephone comprising an apparatus of the above-mentioned type.

The invention is particularly applicable to radiotelephones and portable apparatuses provided with keyboards which can be used in low-luminosity conditions.

SUMMARY OF THE INVENTION

European patent application EP 818 793 A1 describes a contact detection device which is uniformly illuminated and is constituted by an upper membrane and a lower membrane. The upper membrane is composed of a synthetic material foil constituted by a plurality of layers, of which one layer of electroluminescent material is sandwiched between a transparent film and an insulating layer. The membrane is molded so as to form domes on its surface. A contact electrode layer is subsequently formed on the insulating layer, on the internal surface of the dome. The lower membrane comprises a foil of insulating material on which an opposite contact electrode layer is formed which is intended to realize an electric contact with the first contact electrode layer.

SUMMARY OF THE INVENTION

It is an object of the invention to provide means for realizing a contact detection device comprising an integrated illumination system having a smaller thickness and weight, and a lower manufacturing cost than the known device.

To this end, a device as described in the opening paragraph is characterized in that a layer of electroluminescent material is directly applied on the first film, on a plane surface surrounding said external surface.

In contrast to the known device, the layer of electroluminescent material is not sandwiched in a membrane (the first membrane) and subsequently molded in the mass so as to form a dome. In the device according to the invention, the layer of electroluminescent material is deposited on the first insulating film around or between the external parts which have already been molded. The major drawback of the known device is indeed the difficulty of obtaining a dome by way of molding the membrane without destroying the fragile electroluminescent material. There is a risk that the electroluminescent inks, which are sensitive to heat and the exertion of pressure, are damaged in such a treatment. For this reason, the invention recommends deposition of the electroluminescent ink on a plane surface after formation of the domes.

According to a characteristic feature of the invention, said first and second insulating films are constituted by a folded foil of synthetic material, with said contact electrode layer facing said detection circuit. The functions of detection and illumination of the keyboard are thus completely integrated in a single component of small thickness and weight. An advantage of the invention is that the manufacture of the detection device for the keyboard can thus be entirely subcontracted.

It is another object of the invention to provide a data communication apparatus comprising a keyboard and a detection device as mentioned above, characterized in that each key is associated with a dome for exerting a pressure force on said external surface.

A further object of the invention is to provide a radiotelephone comprising such an apparatus, characterized in that said keyboard comprises parts of a translucent material proximate to the keys so as to be illuminated by said layer of electroluminescent material.

These and other aspects of the invention are apparent from and will be elucidated, by way of non-limitative example, with reference to the embodiments described hereinafter.

DETAILED DESCRIPTION OF THE INVENTION

Figure 1:
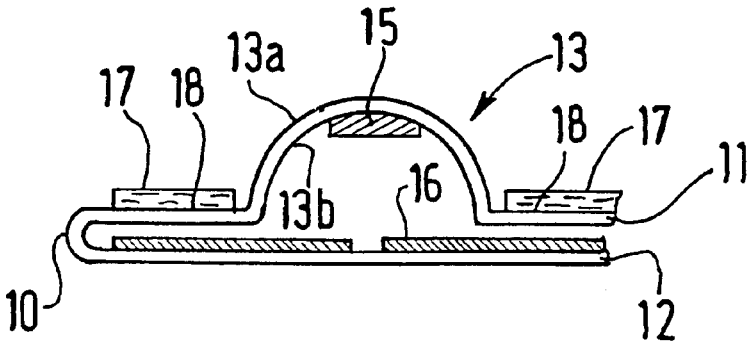
FIG. 1 is a sectional view of a contact detection device according to the invention.

The device of FIG. 1 shows an insulating foil 10 of synthetic material, for example of polyester, which is folded so as to form a first film 11 and a second film 12. The first film 11 has a preformed relief structure 13 in the form of a dome having an external surface 13*a* and an internal surface 13*b*. A contact electrode 15 constituted, for example, by a bead of silver, is fixed on the internal surface 13*b* of the dome. The second film 12 has a printed detection circuit 16 intended to detect an electric contact with the contact electrode 15. A layer 17 of electroluminescent material is deposited on the first film 11, on a plane surface 18 around the external surface 13*a* of the dome 13. This layer 17 is constituted by an electroluminescent ink sandwiched between two electric current conductors. The ink is illuminated in known manner under the influence of the current.

The thickness of the assembly formed by the layers 12, 16, 11 and 17 is of the order of 400 $\mu$m, the electroluminescent layer having a thickness of the order of 200 $\mu$m and the films 11 and 12 having a thickness of approximately 100 $\mu$m. The path under the dome between the bead 15 and the circuit 16 is limited to 400 $\mu$m so that the device may have a total thickness of less than 800 $\mu$m.

Figure 2:
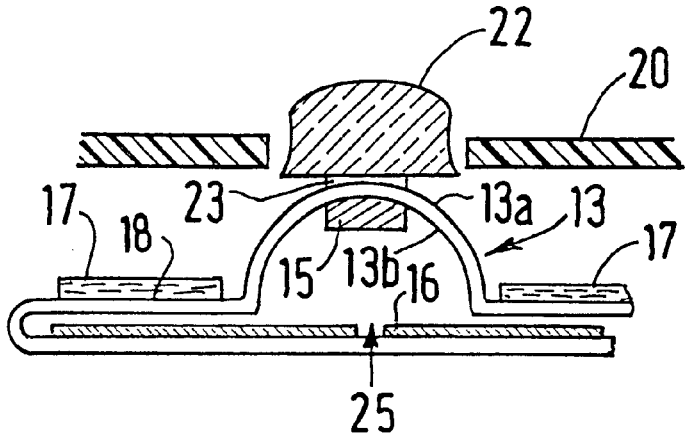
FIG. 2 is a sectional view of a data communication apparatus according to the invention.

FIG. 2 is a partial sectional view of an apparatus constituted by a keyboard and the device shown in FIG. 1. The keyboard 20 has a key 22 arranged above the dome 13. A contact pin 23 allows exertion of a pressure force on the dome 13 when the key 22 is pressed. The flexible dome 13 is deformed under the pressure of the contact pin 23 so as to realize an electric contact between the contact electrode 15 and the detection circuit 16 at the location of a contact zone 25. The key 22 may be realized in a translucent or partially translucent material so as not to be an obstacle to the luminous rays emitted by the electroluminescent layer 17. This system allows a uniform illumination of the key 22.

Figure 3:
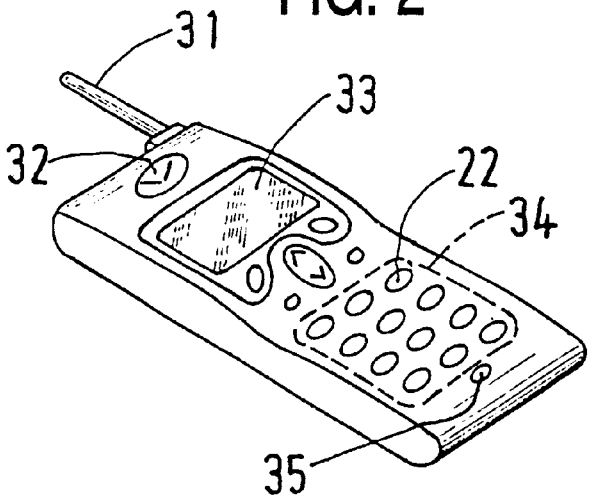
FIG. 3 shows a radiotelephone according to the invention.

The radiotelephone shown in FIG. 3 is provided with the apparatus shown diagrammatically in FIG. 2. It also comprises in known manner: an antenna 31, a receiver, or loudspeaker, 32, a liquid crystal display screen 33, a complete keyboard 34 and a microphone 35.

In accordance with a particular embodiment of the invention, the surface of the synthetic material film, denoted by the reference numeral 18 in FIGS. 1 and 2, on which the electroluminescent material layer denoted by the reference numeral 17 in these Figures is deposited, extends under the liquid crystal display screen 33 so as to simultaneously illuminate the keys of the keyboard 34. A module having a very small thickness and integrating all the functions of illumination of the radiotelephone and detection of the keyboard has thus been realized.

It will be evident that the examples described above and shown in the drawing are not limitative and that there are numerous variants of realizing the invention which can be based on this description without departing from the scope of the invention.

What is claimed is:

1. A contact device comprising:

a first insulating film having a dome and a planar surface surrounding said dome;

a contact electrode formed on an inner surface of said dome;

a second insulating film;

a detection circuit located over said second insulating film, said detection circuit detecting an electric contact between said contact electrode and said detection circuit; and an electroluminescent layer formed on said planar surface of said first insulating film having said dome, wherein said planar surface is located between a portion of said detection circuit and said electroluminescent layer, and said dome is contactable by a contact pin.

2. The contact device of claim 1, wherein said electroluminescent layer is formed on said planar surface without being formed on said dome.

3. The contact device of claim 1, wherein said first insulating film and said second insulating film are formed from a single foil which is folded so that said contact electrode faces said detection circuit.

4. The contact device of claim 3, wherein said single foil is formed from synthetic material.

5. The contact device of claim 1, wherein a pressure on said dome deforms said dome so that said contact electrode contacts said detection circuit.

6. A communication apparatus comprising a keyboard having keys, wherein each of said keys is capable of exerting pressure on a corresponding dome of a contact device; said contact device comprising:

a first insulating film having said dome and a planar surface surrounding said dome;

a contact electrode formed on an inner surface of said dome;

a second insulating film;

a detection circuit located over said second insulating film, said detection circuit detecting an electric contact between said contact electrode and said detection circuit; and an electroluminescent layer formed on said planar surface of said first insulating film having said dome, wherein said planar surface is located between a portion of said detection circuit and said electroluminescent layer, and said dome is contactable by a contact pin.

7. The communication apparatus of claim 6, wherein said electroluminescent layer is formed on said planar surface without being formed on said dome.

8. The communication apparatus of claim 6, wherein said keys are formed from translucent material.

9. The communication apparatus of claim 6, further comprising a screen, wherein said planar surface extends under said screen.

10. The communication apparatus of claim 9, wherein said screen is a liquid crystal display screen.

11. The data communication apparatus of claim 6, wherein said communication apparatus is a radiotelephone.

12. A method of forming a contact device comprising:

forming a first insulating film having a dome and a planar surface surrounding said dome;

forming a contact electrode on an inner surface of said dome;

forming a second insulating film;

forming a detection circuit located over said second insulating film, said detection circuit detecting an electric contact between said contact electrode and said detection circuit; and forming an electroluminescent layer on said planar surface of said first insulating film having said dome, wherein said planar surface is located between a portion of said detection circuit and said electroluminescent layer, and said dome is contactable by a contact pin.

13. The method of claim 12, wherein said electroluminescent layer is formed on said planar surface without being formed on said dome.

14. The method of claim 12, wherein said electroluminescent layer is formed after forming said first insulating film having said dome to prevent damage to said electroluminescent layer.

* * * * *